United States Patent [19]

Goffe

[11] 3,971,658

[45] July 27, 1976

[54] IMAGING PROCESS EMPLOYING FRICTION CHARGING IN THE PRESENCE OF AN ELECTRICALLY INSULATING LIQUID

[75] Inventor: William L. Goffe, Webster, N.Y.

[73] Assignee: Xerox Corporation, Stamford, Conn.

[22] Filed: Apr. 24, 1975

[21] Appl. No.: 571,196

Related U.S. Application Data

[60] Division of Ser. No. 341,217, March 14, 1973, Pat. No. 3,907,559, which is a continuation-in-part of Ser. No. 863,664, Oct. 3, 1969, abandoned, which is a continuation-in-part of Ser. No. 553,438, May 27, 1966, abandoned.

[52] U.S. Cl. ..... 96/1 C; 96/1 LY; 317/262 A; 427/17

[51] Int. Cl.[2] ..... G03G 13/02; G03G 13/10

[58] Field of Search ..... 96/1 C, 1 LY; 427/17; 355/3 CH; 317/262 A

[56] References Cited

UNITED STATES PATENTS

| | | | |
|---|---|---|---|
| 2,297,691 | 10/1942 | Carlson | 96/1 R |
| 2,860,048 | 11/1958 | Deubner | 96/1 R |
| 2,892,709 | 6/1959 | Mayer | 96/1.3 |
| 2,987,660 | 6/1961 | Walkup | 355/3 CH X |
| 3,251,688 | 5/1966 | Mihajlov | 96/1 LY |
| 3,427,242 | 2/1969 | Mihajlov | 96/1.3 X |
| 3,485,738 | 12/1969 | Carreira | 96/1.3 X |
| 3,540,885 | 11/1970 | Honjo et al. | 96/1 LY |
| 3,546,545 | 12/1970 | Sato et al. | 96/1 C X |
| 3,549,962 | 12/1970 | Roth et al. | 96/1 C X |
| 3,569,803 | 3/1971 | Sato et al. | 355/10 X |
| 3,586,615 | 6/1971 | Carreira | 96/1.3 X |
| 3,717,461 | 2/1973 | Honjo | 96/1 LY |
| 3,725,059 | 4/1973 | Komp | 96/1 LY X |
| 3,748,127 | 7/1973 | Amidon et al. | 96/1 LY |

*Primary Examiner*—David Klein
*Assistant Examiner*—John R. Miller
*Attorney, Agent, or Firm*—James J. Ralabate; Michael H. Shanahan; Max J. Kenemore

[57] ABSTRACT

Friction charging of insulating and photoconductive insulating members is accomplished in the presence of an insulating liquid. In a preferred embodiment, the insulating liquid is a developer liquid and the friction charging step may simultaneously erase a previously developed image.

9 Claims, 3 Drawing Figures

Figure 1:
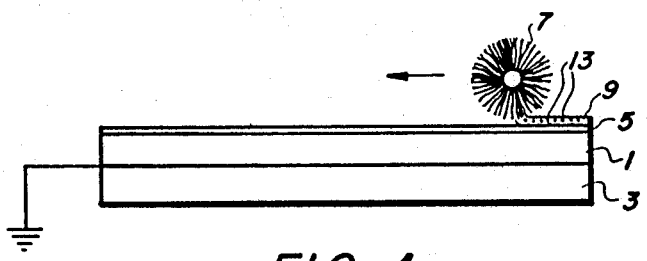

IMAGING PROCESS EMPLOYING FRICTION CHARGING IN THE PRESENCE OF AN ELECTRICALLY INSULATING LIQUID

CROSS-REFERENCE TO RELATED CASES

This application is a division of copending application Ser. No. 341,217, filed Mar. 14, 1973, now U.S. Pat. No. 3,907,559 which is a continuation-in-part of prior copending application Ser. No. 863,664, filed Oct. 3, 1969, now abandoned, which was a continuation-in-part of prior copending application Ser. No. 553,438, filed May 27, 1966 and now abandoned.

BACKGROUND OF THE INVENTION

This invention relates in general to imaging and in particular to electrography, including xerography, using liquid developers.

The use of electrostatic charge patterns to form images is well-known in the art. Probably the more common process in which electrostatic charge patterns are used to form images is xerography. In the art of xerography, exemplified by Carlson, U.S. Pat. No. 2,297,691, it is usual to employ the simultaneous application of electric field and a pattern of activating radiation on a photoconductive insulating member to form an electrostatic charge pattern otherwise known as an electrostatic latent image. This electrostatic latent image is then capable of being utilized such as, for example, by the deposition of electrostatic material thereon to form a visible image. Usually, the order of procedure is to sensitize the xerographic plate by applying a uniform charge to the surface to the photoconductive member after which exposure is made. Sensitization may be accomplished by any of various means, such as, for example, frictional means as disclosed in the Carlson patent or ion charging means as shown in Carlson U.S. Pat. No. 2,588,699.

Other techniques for forming electrostatic charge patterns are known. For example, in U.S. Pat. No. 3,518,081 to Bickmore and Goffe an imagewise modification is made to a surface to alter imagewise capability of the surface to accept charge. By triboelectrically charging such a surface, a charge pattern is formed which may be developed by contacting the surface with colored electroscopic marking particles which are attracted to the charge pattern.

Another broad general branch of electrostatography is generally referred to as electrography and it is considered distinct from the xerographic branch in that it does not employ a photoconductor and light exposure to control the formation of its latent electrostatic charge pattern. Electrography as it is generally known today may be divided into two broad sectors which are, xeroprinting and TESI recording. Xeroprinting may be described as the electrostatic analog of ordinary printing. This process, which is more fully described in U.S. Pat. No. 2,576,047 to Schaffert, employs a xeroprinting plate made up of a pattern of insulating material on a conductive backing so that when the xeroprinting plate is charged, as with a corona discharge electrode, an electrostatic charge pattern is retained only on the patterned insulating sections of the plate. Image development is by the same techniques employed in xerography.

The common feature of all of these electrostatographic systems is that they employ the lines of force from the electric field of a latent electrostatic image to control the deposition of colored finely divided marking particles known as toner, thus forming a visible image corresponding to the charge pattern. The colored finely divided marking particles may be in dry powder form or may be suspended in an insulating liquid. The use of insulating liquids containing developer particles is well-known to the art. See, for example, U.S. Pat. No. 3.053,688 to Greig.

The above tehniques are useful for forming hard copy or for displays. Where it is desired to reuse the member on which the image is formed, it is necessary to remove the image, clean the member, and recharge the member, either imagewise, or uniformly with subsequent imagewise dissipation of the charge.

In addition to the use of marking particles to make charge patterns visible, other methods are known. In one such method described in U.S. Pat. No. 3,196,010 to Goffe et al. a thin, from about 80 to about 125 millimicrons, layer of an insulating "developer" liquid is formed over the charge pattern. The electrostatic image creates interference or light scattering patterns in the liquid which are visible. The liquid may also contain a wax or dissolved material which will form a more permanent solid image as taught in U.S. Pat. No. 3,196,010 to W. L. Goffe et al. issued July 20, 1965, the disclosure of which is incorporated herein by reference.

A further technique for making electrostatic latent images visible is by using liquid crystal materials. The electrostatic field causes phase changes or changes in optical polarization which appear as differences in color or opacity. The use of liquid crystal materials to develop electric fields is shown in U.S. Pat. No. 3,642,348, issued Feb. 15, 1972, and U.S. Pat. No. 3,707,322, issued Dec. 26, 1972, which patents are assigned to the assignee of this application and which disclosures are incorporated herein by reference.

The techniques described in the last two paragraphs above are particularly useful for image display purposes. Again, in order to reuse the member on which the image is formed, it is usually necessary to remove the image, clean the member, and form a new charge pattern on the member. Normally, the above processes are carried out using ion charging means such as a corona discharge or by contacting the free surface of the developing liquid with a second electrode and applying a potential difference between the photoconductive member and the second electrode. These techniques, although successful, require expensive and bulky equipment, and high potentials. Further, usually several processing steps are required to form a charge pattern, develop the image, remove the image, clean the member on which the image is formed and to reform the charge pattern.

SUMMARY OF THE INVENTION

It is, therefore, an object of this invention to provide a system for charging an insulating or photoconductive insulating member which overcomes the above noted disadvantages.

It is another object of this invention to provide a simplified display system.

It is another object of this invention to provide a system for the substantially simultaneous cleaning and charging of an insulating or photoconductive insulating member.

It is another object of this invention to provide a system for substantially simultaneously charging, cleaning and applying a developing liquid to an insulating or photoconductive insulating liquid.

It is another object of this invention to provide an image display system which does not require a power supply.

The foregoing objects and others are accomplished in accordance with this invention by a system comprising providing an insulating or photoconductive insulating member and charging the member by friction charging in the presence of an insulating liquid. Friction charging the member in the presence of a liquid simultaneously cleans and charges the member. In a preferred embodiment the insulating liquid is also capable of making an electrostatic latent image visible in which case, the liquid is referred to as a "developing liquid". The phrase developing liquid is intended to include insulating liquids containing particles which will migrate to charged or uncharged areas of the image or both; liquids capable of forming interference or light scattering patterns in response to electrical field whether they include suspended or dissolved solids; liquid crystal materials; and liquids containing dissolved or suspended materials which deform in response to electric field when in layer form. Where friction charging is carried out in the presence of a developing liquid, the process is capable of charging, cleaning, and developing an image in one step.

Where a photoconductive insulating material is friction charged in the presence of a liquid, an improvement in results can often be obtained by overcoating the photoconductive member with a thin insulating material. The thin overcoating may be selected on the basis of its triboelectric charge acceptance capability, that is by how high a charge can be formed on the material by friction charging. Selection of different overlay materials or rubbing materials can control the sign of the charge placed in the overcoating. The overcoating is used in a thickness which will not interfere with the operation of the photoconductor and may itself be photoconductive in which case a thicker layer may be used. Alternatively, the overcoating may be formed on the photoconductive member in a screen pattern. Friction charging in the presence of an insulating liquid in this case provides a screen pattern charge.

In a further embodiment, an imagewise pattern of an insulating material may be formed on a conductive substrate. Friction charging in the presence of a liquid will here form a charge on the insulating surface which can be developed by the techniques disclosed herein. In this embodiment a particularly useful system employs particles which deposit on the insulating pattern and are then transferred to an image receiving surface. This system is particularly useful for duplicating. Friction charging in the presence of an insulating liquid containing developer particles, charges the plate, cleans the plate and applies developer materials simultaneously.

The advantages of this improved method of charging an insulating or photoconductive insulating member will become apparent upon consideration of the following detailed disclosure of the invention. The best results are obtained by using a selenium xerographic plate as the photoconductive insulating member because the selenium xerographic plate has excellent sensitivity and the ability to receive and retain a uniform charge with comparatively low dark decay which is particularly important for a reusable photoconductive display system. The selenium xerographic plate is preferably coated with a special organic photoconductor, referred to hereafter, as SOP. SOP is formed from a solution containing approximately 143 grams of PKDA 8500, a phenoxy resin available from the Union Carbide Co.; 10.0 grams of 1% Rhodamine B, an aminophenylxanthene dye in ethanol; 14.4 grams of TO-1920, 2,5-bis-(p-aminophenyl)-1,3,4-oxadiazole; 100.0 grams of cyclohexanol; 28.5 grams of Uformite 200 E, a melamine formaldehyde resin available from Rohm and Haas. The SOP is rubbed on as a liquid and allowed to dry. The SOP, being itself photoconductive, may be placed in any desired thickness on the photoconductive member. The toner image, when developed, is found to be substantially as sharp as images obtained on the same selenium xerographic plate with corona charging. The SOP-coated plate is also found to be abrasion resistant. Rubbing after image development in the presence of an insulating liquid, recharges the surface of the SOP to the same high, uniform surface charge obtained initially.

Any suitable insulating member may be used. Typical photoconductive insulating materials include inorganic photoconductors, such as zinc oxide, cadmium sulfide, zinc sulfide, lead sulfide, cadmium selenide, selenium, lead iodide, lead chromate, and mixtures thereof; organic photoconductors such as triphenyl amine; 2,4-bis-(4,4'-diethyl-aminophenyl)-1,3,4-oxadiazole; N-isopropyl carbazole; triphenyl pyrrol; 4,5-diphenylimidazolidinone; 1,4-dicyano naphthalene; 2-mercaptobenz-thiazole; 2,4-diphenyl-quinazoline; 5-benzideneaminoacenaphthalene; and mixtures thereof. These materials may be used as the photoconductive layer by themselves as a one-phase photoconductor or in a suitable binder.

Typical binders are selenium, polystyrene resins, silicone resins, acrylic and methacrylic polymers and copolymers and mixtures thereof. Typical non-photoconductive insulating members known in the art are: non-self-supporting or self-supporting films of organic resins, plastics, binders including cellulose, cellulosic materials, and insulating resins such as lacquer coatings, and resin films and layers including urea and melamine type resins, vinyl resins, acrylic resins and mixtures thereof.

The thin overcoating may also comprise any suitable material which can be readily coated on the surface of the insulating or photoconductive insulating member. Important requirements for the thin overcoating are that the material be abrasion resistant or replenishable and have the desired triboelectric properties. Materials having the desired triboelectric properties may be selected from a triboelectric series. For example, if it is desired to place a positive charge on the surface of the thin overcoating, the overcoating material will be selected from those materials positioned relatively high on the triboelectric series and rubbed with a material positioned below it on the triboelectric series. Conversely, if it is desired to place a negative charge on the surface of the thin overlay, the thin overlay material may be selected from those materials positioned relatively on the triboelectric series and rubbed with a material positioned above the overlay material on the triboelectric series. Typical materials are: Kodak Photoresist (available from the Eastman Kodak Company of Rochester, N.Y.), which may be described generally as the cinnamate esters of polyvinyl alcohol and cellulose, SOP, nonself-supporting or self-supporting films or organic resins, plastics, binders including cellulose, cellulosic materials, and insulating resins such as lacquer coatings and resin films and layers including urea and melamine type resins, vinyl resins, acrylic resins and mixtures thereof. The thin overcoating may also comprise any of the photoconductive insulators or photoconductive insulators in a binder or mixtures thereof listed above. The thickness of the thin overcoating may be so thin as to be monomolecular. Alternatively, the thin overlayer may be placed on the surface of the photoconductive insulating member member in any thickness so long as the thin overlay does not substantially interfere with the desired properties of the photoconductive insulating member. Where the insulating layer is formed in an imagewise pattern on a conductive substrate, it may be present in any desirable thickness.

The insulating or developing liquid should not affect the material which is being charged or the friction charging material itself. The insulating or developing liquid may be any suitable material which will not discharge an electrostatic image. Typical materials known in the art are: Sohio Odorless Solvent 3440, a mixture of kerosene fractions, silicone oils such as Dow Corning 200 Silicone Oil, 0.65 centistoke, 1.0 centistoke, 50 centistoke and 100 centistoke, mineral oil, decane, dodecane, N-tetradecane, molten paraffin, and Narcoil 40 diffusion pump oil, a di-nonylphthalate ester available from the National Research Corporation, developing liquids such as those disclosed in U.S. Pat. No. 3,053,688 to Grieg and mixtures thereof.

The friction charging material may comprise any suitable material having the desired triboelectric properties selected from the triboelectric series in accordance with its relation in the triboelectric series to the material used as the insulating or photoconductive insulating material. Typical materials known in the art are: rubber, fur, wool, rayon, felt, hair, velvet, woven or knit cotton, or other suitable charging materials. The thin overcoating may be coated on the surface of an insulating photoconductor in a screen pattern to improve solid area coverage in xerographic processes.

Figure 2:
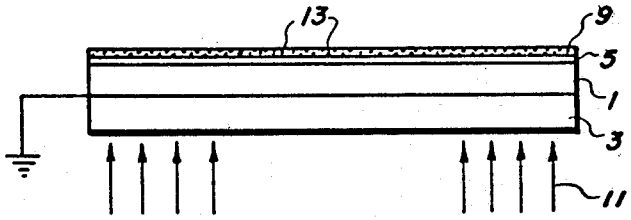
Figure 3:
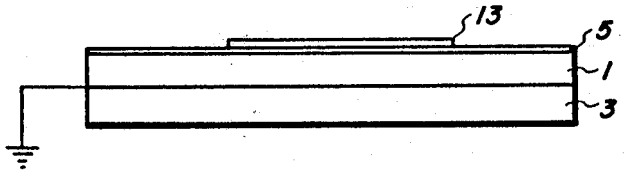

The advantages of this improved method of charging an insulating member will become apparent upon consideration of the detailed disclosure of the invention, especially when taken in conjunction with the accompanying drawings wherein:

FIGS. 1, 2 and 3 show a succession of process steps which provide an imaging system in accordance with this invention.

Referring now to FIG. 1, there is seen a selenium xerographic plate comprising, for example, an 80 micron layer 1 of photoconductive selenium on transparent conductive substrate 3 which may be, for example, NESA glass (a tin oxide coated glass). The xerographic plate is overcoated with a thin layer 5 of SOP defined earlier in the disclosure. Brush 7 having, for example, rayon fibers wet with developer liquid 9 containing marking particles 13 is rotated rapidly and caused to traverse layer 5 in the dark. Examples of such developing liquids are described, for example, in U.S. Pat. No. 3,053,688 to Grieg. On completion of brush 7 traverse of layer 5, a thin layer 9 of developer liquid which contains electrostatic marking particles 13 is found on layer 5. The charging also provides a high potential on surface 5.

Referring now to FIG. 2, the highly charged xerographic member having a layer 9 of developer liquid thereon is then exposed to an imagewise pattern of radiation 11 which allows charges to dissipate to ground, leaving a charge pattern on layer 5. It should be pointed out here that the imagewise exposure 11 may also occur through layer 9 and 5 and may also be simultaneous with the friction charging. Also, the liquid could be applied to the plate prior to brush traverse.

Referring now to FIG. 3, there is seen particulate image area 13 here greatly exaggerated which comprises electroscopic particles attracted from liquid layer 9. Where the image is to be transferred, the liquid may be removed by evaporation or other convenient methods, such as absorption or allowing it to run off. It should be pointed out that the marking particles 13 are attracted to areas of large potential difference and therefore tend to develop "edge effects" preferentially producing high quality line copy. For high quality broad area coverage, it is necessary only to provide layer 5 in a screen pattern which will initially provide a screen pattern charge providing edge effects throughout image areas. Where a screen pattern charge is desired, the screen pattern may be applied, for example, using a gravure roller. The resulting pattern should have 50 to 60 more spots of overlay per inch. The advantages of screen pattern charging are well known in the art. See, for example, U.S. Pat. No. 2,598,732 to Walkup.

Particulate image 13 may be fixed in place or transferred and fixed by conventional xerographic techniques, if desired; however, the system is particularly useful as a display since all that is necessary to form a new image is to traverse layer 5 in the dark with brush 7 and re-expose to an image. The liquid used for a display system would be selected to be relatively nonvolatile.

In addition to the use of a developing liquid containing marking particles to instantaneously make electrostatic images visible upon application of the developer liquid, a number of other techniques can be used. For example, where the insulating developer liquid used for friction charging forms a layer on the photoconductor of thickness in the range of from about 80 to about 125 millimicrons, the electrostatic image creates interference colors or light scattering patterns in the liquid which are visible. In this connection, the liquid may be a combination of a wax and solvent or a solid material which can be converted to a liquid material. The use of these films to develop electrostatic images is set out in U.S. Pat. No. 3,196,010.

Further, the electrostatic image may be made visible by using a soft solid material which can be deformed by the electrostatic pattern. These materials can be applied in solution or suspension form while charging as described above. The image is again readily removed by frictionally contacting the image in the presence of a solvent or suspending medium. Again, the photoconductive layer may be overcoated uniformly or in a screen pattern.

A further technique is to use an insulating developer liquid which contains or is made up of a liquid crystal material. The use of liquid crystal materials to develop or make visible electrostatic charge patterns is well-known and depends, for example, on phase changes caused by the charge pattern or a change in optical polarization caused by the charge pattern which result in color or opacity differences in the liquid crystal material. The use of both cholesteric and nematic liquid crystals is contemplated. Patents showing the use of liquid crystals to develop or make visible electrical fields are, for example, U.S. Pat. Nos. 3,642,348 and 3,707,322.

The following examples further specifically illustrate various preferred embodiments of the improved friction charging method. The parts and percentages are by weight unless otherwise indicated.

EXAMPLE I

A selenium xerographic plate comprising an 80 micron selenium photoconductive layer on a NESA glass substrate is coated with a layer of Kodak Photoresist (KPR). The KPR is rubbed on with a cloth material and allowed to dry providing about a one-half micron layer. The KPR is then charged by rubbing with a rayon cleaning absorbent soaked in a developer composition comprising carbon black pigmented polystyrene suspended in Sohio Odorless Solvent 3440. A surface charge potential of about +500 volts is generated. The coated selenium xerographic plate with the developer liquid still present on it is exposed to an image. The suspended particles migrate forming an image on the surface of the KPR. The plate is then rubbed again with the developer soaked rayon which cleans the plate, recharges the plate and applies developer preparing the plate for a second imaging cycle.

EXAMPLE II

The experiment of Example I is repeated except that the developer liquid is provided as follows. A Staybelite resin is dissolved in heated Sohio Odorless Solvent 3440. The solution is allowed to cool which causes some of the resin to precipitate forming a white powder in suspension. Rubbing here causes a charge of over +1000 volts to be generated. High quality images are formed as in Example I except that in this example, white images are formed. By rubbing again in the presence of the developer liquid, the plate is cleaned, recharged, and is used to form a second image of high quality.

EXAMPLE III

The xerographic plate of Example I is coated with a one-half micron layer of SOP. The plate is then charged by rubbing with a rayon material soaked with a developer liquid made up of carbon black pigmented polystyrene suspended in Sohio. A charge of about +1000 volts is obtained. Exposure to an image as above provides a high quality image on the surface of the plate. The plate is then cleaned, recharged and developer reapplied by rubbing again with the rayon absorbent soaked in the developer liquid.

EXAMPLE IV

The experiment of Example III is repeated except that the developer liquid is replaced by a developer liquid made up of fine particles of Staybelite suspended in Sohio. Again, high quality images are prepared.

EXAMPLE V

The coated plate of Example I is charged by rubbing with rayon soaked in Dow Corning 200 Silicone Oil 10.0 centistoke containing carbon black pigmented polystyrene, while the plate is exposed to an image through the NESA glass plate providing a black particulate image corresponding to unexposed areas of the photoconductor. Rerubbing during exposure to a second image forms a corresponding second image.

EXAMPLE VI

An uncoated selenium xerographic plate is charged as in Example V, except the liquid is 1.0 centistoke oil containing carbon black pigmented polystyrene particles. Images are formed as in Example V, but complementary thereto.

EXAMPLE VII

The coated plate of Example I is charged by rubbing with rayon soaked in Dow Corning 200 Silicone Oil, 0.65 centistoke containing the particles of Example VI. Images are formed as in Example V.

EXAMPLE VIII

The experiment of Example VII is repeated using Narcoil 40 diffusion pump oil in place of the silicone oil. High quality images are again formed.

EXAMPLE IX

The coated plate of Example I is charged by rubbing with rayon soaked in Sohio providing a uniform potential of over +1000 volts.

EXAMPLE X

The SOP coated plate of Example III is charged by rubbing with rayon soaked with Dow Corning 200 Silicone Oil 1.0 centistoke providing a potential of about +1000 volts.

EXAMPLE XI

The experiment of Example X is repeated using a rayon cloth soaked with Sohio providing a potential of about +800 volts.

EXAMPLE XII

An uncoated selenium surface is charged as in Example XI providing a potential of about −1000 volts.

Any of the charged members of Examples IX through XII may be used for providing an image by exposing the member to a pattern of light and developing using preferably liquid developers. Recharging as in Examples IX through XII cleans and recharges simultaneously.

EXAMPLE XIII

A 50 micron selenium film formed on the conductive surface of a NESA glass plate is rubbed vigorously with a tissue soaked in a dilute solution of ceresin wax in trichloroethylene while the selenium is exposed to an image through the NESA glass. After a few passes with the soaked tissue, a visible imagewise change appears in the interference colors associated with the thin film formed. The imagewise change in colors indicates a thicker wax coating over the unexposed highly charged areas at the edges of the charge pattern. The image thus formed is relatively more permanent than a liquid image being of a solid material. The solid image is readily removed by rerubbing with a tissue wet with a solvent or rerubbing with the original dilute wax solvent developer solution. Rerubbing removes the image, cleans the photoconductor, recharges the photoconductor and develops a second image projected through the NESA glass.

EXAMPLE XIV

An imagewise pattern of Mylar polyester film is formed on a conductive substrate. The film is charged by rubbing with a developing liquid which is made up of carbon black pigmented polystyrene in Dow Corning Silicone Oil 50.0 centistoke using absorbent rayon. A black particulate image corresponding to the charged resin areas is formed. The image is transferred and the process repeated providing a second image.

Although in the above Examples, rubbing is used to impart surface charge, any method of contact charging may be used, for example, touching, impacting, rolling or twisting are suitable methods.

Although specific components and proportions have been stated in the above description of preferred embodiments of the invention, other typical materials as listed above, if suitable, may be used with similar results. In addition, other materials may be added to the system to synergize, enhance, or otherwise modify the properties of the various layers or liquid developers, for example, charge transfer sensitizers may be added to the thin overcoating to assist in the light discharge of the surface potential.

What is claimed is:

1. An imaging process comprising:

a. providing a photoconductive insulating layer on an electrically conductive substrate;

b. friction charging said photoconductive insulating layer with a second material in the presence of an electrically insulating layer until an electrostatic charge is produced on said photoconductive insulating layer, said second material differing in triboelectric character from said photoconductive insulating layer;

c. exposing said photoconductive insulating layer to an imagewise pattern of radiation to which said photoconductive insulating layer is responsive; and d. contacting said photoconductive insulating layer with an electrically insulating developer liquid until an image is formed.

2. The process of claim 1 wherein said photoconductive insulating layer is overcoated with an electrically insulating third material, said third material differing in triboelectric character from said second material.

3. The process of claim 1 wherein said photoconductive insulating layer is overcoated in a screen pattern with an electrically insulating material having a triboelectric character differing from the photoconductive insulating material and said second material.

4. The process of claim 1 wherein steps (b) and (c) are performed concurrently.

5. The process of claim 1 wherein steps (b), (c) and (d) are repeated at least one additional time.

6. The process of claim 1 wherein said electrically insulating developer liquid forms a thin film and said image is an interference pattern.

7. The process of claim 1 wherein said electrically insulating developer liquid contains marking particles and said image comprises deposited marking particles.

8. The process of claim 1 wherein said electrically insulating developer liquid contains a material which forms a solid thin film and said image comprises an interference pattern.

9. The process of claim 1 wherein said electrically insulating developer liquid comprises a liquid crystal material and said image comprises a difference in color or opacity within said liquid crystal material.

* * * * *

UNITED STATES PATENT AND TRADEMARK OFFICE

CERTIFICATE OF CORRECTION

PATENT NO. : 3,971,658

DATED : July 27, 1976

INVENTOR(S) : William L. Goffe

It is certified that error appears in the above-identified patent and that said Letters Patent are hereby corrected as shown below:

Col. 4, line 60, after tively insert -- low --.

Claim 1, line 6, "layer" should read "liquid".

Signed and Sealed this

Twenty-first Day of December 1976

[SEAL]

*Attest:*

RUTH C. MASON
*Attesting Officer*

C. MARSHALL DANN
*Commissioner of Patents and Trademarks*